United States Patent [19]

Fujii et al.

[11] Patent Number: 4,890,797

[45] Date of Patent: Jan. 2, 1990

[54] AUTOMATIC PAPER FEEDER FOR DOCUMENT SHREDDER

[75] Inventors: Yoshihalu Fujii, Sakurai; Yukitoshi Fujita; Hiroshi Moriyama, both of Yamatokoriyama, all of Japan

[73] Assignee: Sharp Kabushiki Kaisha, Osaka, Japan

[21] Appl. No.: 166,054

[22] Filed: Mar. 9, 1988

[30] Foreign Application Priority Data

Mar. 9, 1987 [JP] Japan ..... 62-54965

[51] Int. Cl.[4] ..... B02C 25/00

[52] U.S. Cl. ..... 241/34; 241/100; 241/225

[58] Field of Search ..... 241/34, 236, 100, 222, 241/224, 223, 225, 243, 35; 271/10, 34, 35, 110, 111, 113, 258, 259

[56] References Cited

U.S. PATENT DOCUMENTS 3,620,461 11/1971 Pelleschi et al. ..... 241/100
4,018,392 4/1977 Wagner ..... 241/236 X
4,124,169 11/1978 Hatanaka .
4,231,530 4/1980 Hatanaka .
4,619,407 10/1986 Goldhammer ..... 241/236 X

FOREIGN PATENT DOCUMENTS 2214800 9/1973 Fed. Rep. of Germany ..... 241/236
2176173 12/1986 United Kingdom .

*Primary Examiner*—Mark Rosenbaum
*Attorney, Agent, or Firm*—Birch, Stewart, Kolasch & Birch

[57] ABSTRACT

An automatic paper feeder for use in a document shredder includes a paper feeding table for receiving, a large number of paper sheets to be shredded in a stack, a feeding roller for feeding the paper sheets to be shredded on the paper feeding table, a set of shredding blades, and a driving device for driving the feeding roller for rotation. The rotational peripheral speed of the feeding roller are set larger than the speed of the shredding blades.

3 Claims, 4 Drawing Sheets

AUTOMATIC PAPER FEEDER FOR DOCUMENT SHREDDER

BACKGROUND OF THE INVENTION

The present invention generally relates to a document shredder for cutting documents to be disposed of (referred to as paper sheets to be shredded hereinafter) into small pieces or narrow strips, and more particularly, to an automatic paper feeder for automatically feeding paper sheets to be shredded in a document shredder.

Conventionally, as shown in FIG. 7, an automatic paper feeder generally includes a paper feeding table T for placing thereon, a stack of many paper sheets P to be shredded, a feeding roller F disposed at a small distance k from a leading edge p of the paper sheet P for feeding said paper sheet P to be shredded, to a set of shredding blades B, a driving device M for driving the feeding roller F for rotation, a pivotal plate Ta for the feeding table T, a pressure spring S for urging said pivotal plate Ta upwardly, a transport roller R, an endless transport belt V passed around said rollers F and R, and a guide path G for guiding the paper sheets P towards the shredding blades B.

In the automatic feeder for the document shredder as described above, it is normally required to cut the paper sheets P to be shredded still more positively and quickly. Although it is essential to increase revolutions of the shredding blades B in order to raise the shredding speed, excessive increase of the revolutions undesirably increases a load to be applied to the shredding blades B, and requires a large-sized driving source or motor for rotating the shredding blades 2. Moreover the shredding blades B are also required to have a sufficient strength to withstand such shredding load, thus inviting a cost increase for satisfying such requirements.

Furthermore, since the feeding roller F is arranged to feed the large number of paper sheets, one sheet by one sheet at its upper or under surface, it is required to have a separating effect. In order to improve such separating effect, the feeding roller F is disposed at a position retreated from the leading edge p of the paper sheet P to be shredded by a preliminarily overlapping length k.

As a result, the paper sheets P are fed in a state of two layers at the forward end portion in which the trailing edge of a preceding paper sheet $P_1$ overlaps the leading edge of a successive paper sheet $P_2$ by the preliminarily overlapping length k as shown in FIG. 6. It is to be noted here, however, that, if the length k is increased, small-sized paper sheets to be shredded can not be fed.

Accordingly, under the specified conditions, increasing the degree of overlapping of the paper sheets P without increasing the length k will provide means for increasing in shredding speed.

SUMMARY OF THE INVENTION

Accordingly, an essential object of the present invention is to provide an automatic paper feeder for use in a document shredder, in which processing time for shredding the paper sheets may be shortened by increasing the degree of overlapping of the paper sheets to be shredded.

Another important object of the present invention is to provide an automatic paper feeder of the above described type which is simple in construction and stable in functioning, and can be readily manufactured at low cost.

In accomplishing these and other objects, according to one preferred embodiment of the present invention, there is provided an automatic paper feeder for use in a document shredder, which includes a paper feeding table for placing thereon, a large number of paper sheets to be shredded in a stack, a feeding roller for feeding the paper sheets to be shredded on the paper feeding table, to a set of shredding blades, and a driving device for driving said feeding roller for rotation, with rotational peripheral speed $V_2$ of said feeding roller being set to be larger than that $V_1$ of said shredding blade.

Such rotational peripheral speed $V_1$ of the shredding blades and that $V_2$ of the feeding roller are so related that the paper sheets are shredded by the shredding blades under a perfectly two-layered state in which the latter half $L_1$ of the preceding paper sheet $P_1$ generally overlaps the first half $L_2$ of the succeeding paper sheet $P_2$ (FIG. 1).

In the above arrangement of the present invention, as shown in FIG. 2, at the starting time point 0t of the feeding roller 3, the preceding paper sheet P1 at the uppermost layer fed at the rotational peripheral speed $V_2$ reached the shredding blades 2 in its leading edge at a time point 4t, and at a time point 5t, since the rotational peripheral speed $V_2$ of the feeding roller 3 is larger than the rotational peripheral speed $V_1$ of the shredding blades 2, the preceding paper sheet $P_1$ is slightly curved, but its trailing edges reaches the position of the feeding roller 3, and thus, in the next moment, the leading edge of the succeeding paper sheet $P_2$ at the second stage is fed by the feeding roller 3 so as to be fed in a state overlapping the under surface of the preceding paper sheet $P_1$ at a time point 6t.

Then, at a time point 9t, the first half of the succeeding paper sheet $P_2$ overlaps the latter half of the preceding paper sheet $P_1$ to form two layers, and these paper sheets $P_1$ and $P_2$ in the state of two layers are cut off by the shredding blades 2.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiment thereof with reference to the accompanying drawings which are given by way of illustration only, and thus, are not limitative of the present invention, and in which.

DETAILED DESCRIPTION OF THE INVENTION

Figure 1:
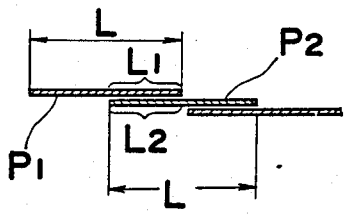
FIG. 1 is a fragmentary side sectional view showing the two-layered feeding state for the preceding paper sheet and the succeeding paper sheet by the automatic paper feeder according to the present invention.

Before the description of the present invention proceeds, it is to be noted that like parts are designated by like reference numerals throughout the accompanying drawings.

Figure 5:
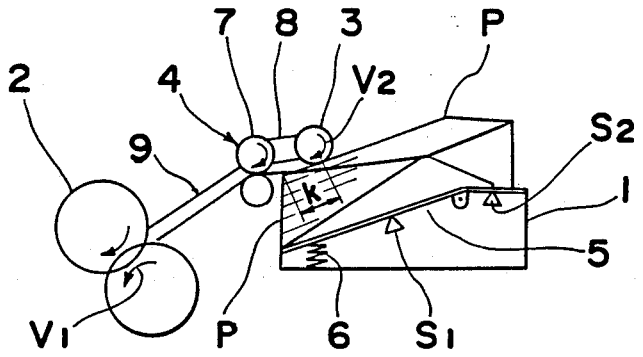
FIG. 5 is a schematic side elevational view of the automatic paper feeder according to the present invention.
Figure 6:
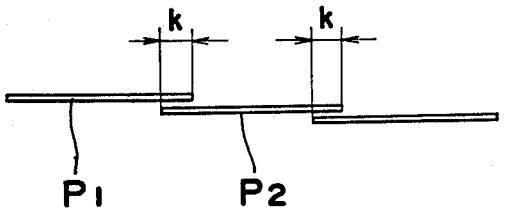
FIG. 6 is a fragmentary side elevational view showing a forward end two-layered feeding state of the preceding paper sheet and succeeding paper sheet by a conventional automatic paper feeder for a document shedder.

Referring now to the drawings, FIG. 5 shows an automatic paper feeder for a document shredder according to one preferred embodiment of the present invention. The automatic paper feeder generally includes a paper feeding table 1 for placing thereon, a large number of paper sheets P to be shredded in a stack, a feeding roller 3 disposed at a position spaced by a preliminarily overlapping length k from the leading edge p of the paper sheet to be shredded for feeding said paper sheets toward a set of shredding blades 2, a driving device 4 for driving the feeding roller 3 to be rotated, size detecting sensors $S_1$ and $S_2$ for detecting sizes of the large paper sheets and small paper sheets placed on the paper feeding table 1, and a control circuit 10 (FIG. 3) which outputs a rotational speed changing signal for feeding roller 3, to the driving device 4 according to paper size signals of said sensors $S_1$ and $S_2$.

Figure 2:
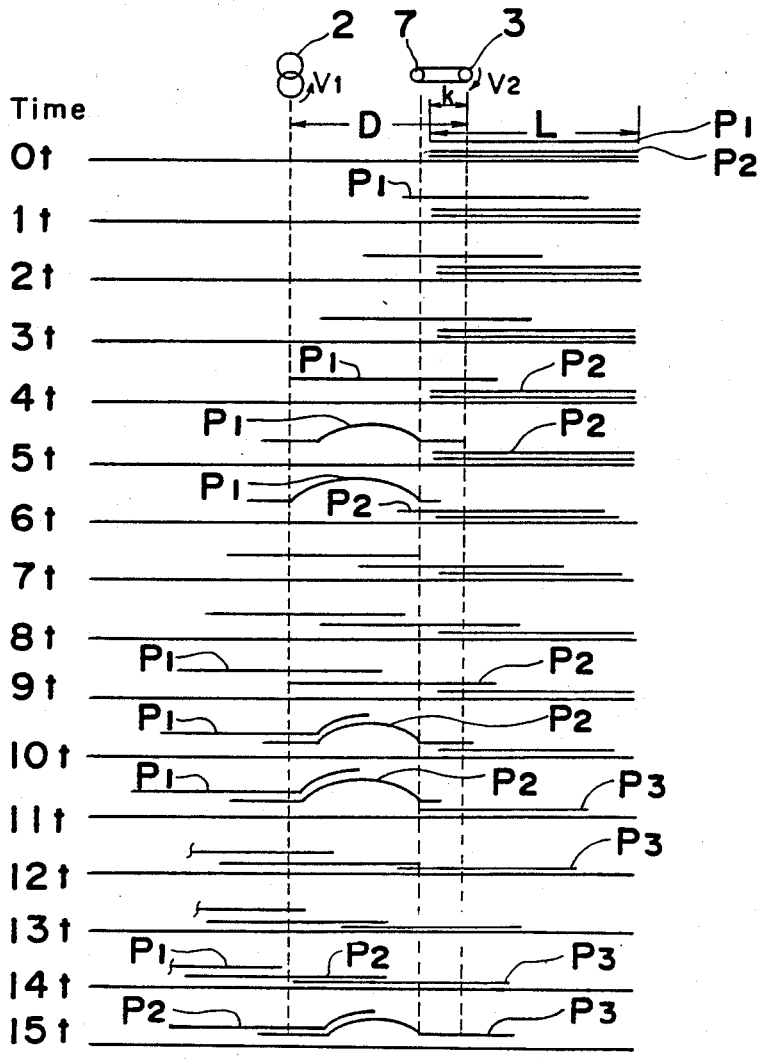
FIG. 2 is a time-chart for explaining the paper feeding and shredding functions for the embodiment of the automatic paper feeder according to the present invention.

In the above arrangement the rotational peripheral speed $V_2$ of said feeding roller 3 is set to be larger than the rotational peripheral speed $V_1$ of said shredding blades 2, and such rotational peripheral speed $V_1$ of the shredding blades 2 and that $V_2$ of the feeding roller 3 are so related that the paper sheets P are shredded by the shredding blades 2 under a perfectly two-layered state in which the latter half L1 of the preceding paper sheet $P_1$ generally overlaps the first half $L_2$ of the succeeding paper sheet $P_2$ (FIG. 1). As shown in FIG. 2, a distance D between the feeding roller 3 (or transport roller 7) and the shredding blades 2 is set to be smaller than a length L in the shredding direction for the paper sheets P.

Figure 3:
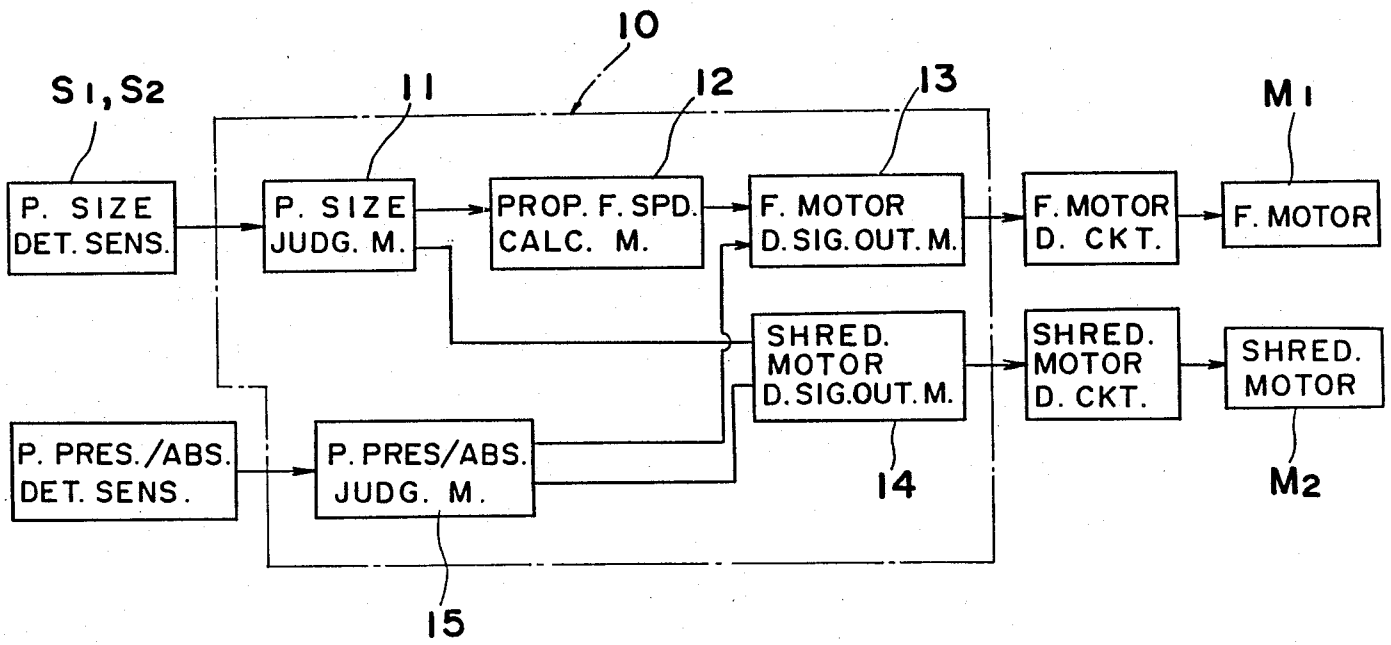
FIG. 3 is a block diagram for explaining a control circuit according to the embodiment of the present invention.

The control circuit 10 referred to above is constituted by a micro-computer, and as shown in FIG. 3, includes a paper size judging means 11 for judging large sized paper sheets and small sized paper sheets by the output from the paper size detecting sensors $S_1$ and $S_2$, a proper feeding speed calculating means 12 for calculating a proper rotational peripheral speed $V_2$ (i.e. rotational speed) of the feeding roller 3 by the output signal of the judging means 11 (the calculating means is preliminarily set so as to slightly increase the rotational speed if the size of the paper sheet P to be shredded becomes large), a feeding motor driving signal output means 13 for driving the driving force (a motor $M_1$) for the feeding roller 3 by the output signal of the calculating means 12, a shredding motor driving signal output means 14 for driving the driving device (a motor $M_2$) for the shredding blades 2, and a paper presence/absence judging means 15 for judging whether the paper sheet is present or absent by the output of paper presence/absence detecting sensors coupled therewith (the paper size detecting sensors $S_1$ and $S_2$ may be commonly used for such paper presence/absence detecting sensors).

The proper feeding speed calculating means 12 is preliminarily set so as to slightly increase the rotational peripheral speed $V_2$ when the size of the paper sheet P to be shredded becomes larger as referred to earlier and represented by the following equation.

$$V_2 = 2V_1 \cdot (L-k)/L$$

where $V_1$: Shredding blades rotational peripheral speed, $V_2$: Feeding roller rotational peripheral speed, L: Paper sheet length in shredding direction, k: Preliminarily overlapping length of the paper sheets to be shredded.

Figure 7:
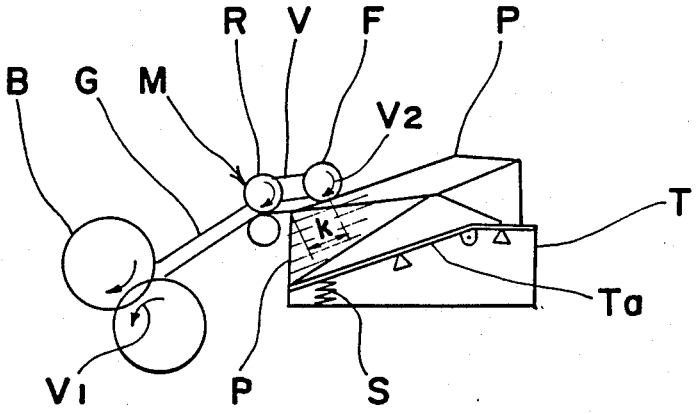
Fig. 7 PRIOR ART
FIG. 7 is a view similar to FIG. 5, which particularly relates to a conventional automatic paper feeder.

The automatic paper feeder according to the present invention is generally similar in other constructions to the conventional paper feeder described with reference to FIG. 7, and further includes a pivotal plate 5 for the feeding table 1, a pressure spring 6 for urging said pivotal plate 5 upwardly, a transport roller 7, an endless transport belt 8 passed around said rollers 3 and 7, and a guide path 9 for guiding the paper sheets P towards the shredding blades 2.

It should be noted here that, in the foregoing embodiment, although the feeding roller 3 is of a type which feeds the paper sheets P from the uppermost one in the stack such a feeding roller may be modified to a type which feeds the paper sheets P from the lowermost one in the stack.

It should also be noted that, in the arrangement of FIG. 5, if the pressure of the pressure spring 6 is too strong, excessive resistance is applied between the paper sheets P to be shredded, resulting in transport of multiple shut. However, if the pressure of the spring 6 is too weak, sufficient feeding force for the paper sheets P is not available, and therefore, the spring pressure is specified so that the feeding force for the paper sheets P by the feeding roller 3 becomes about 200 g.

Figure 4:
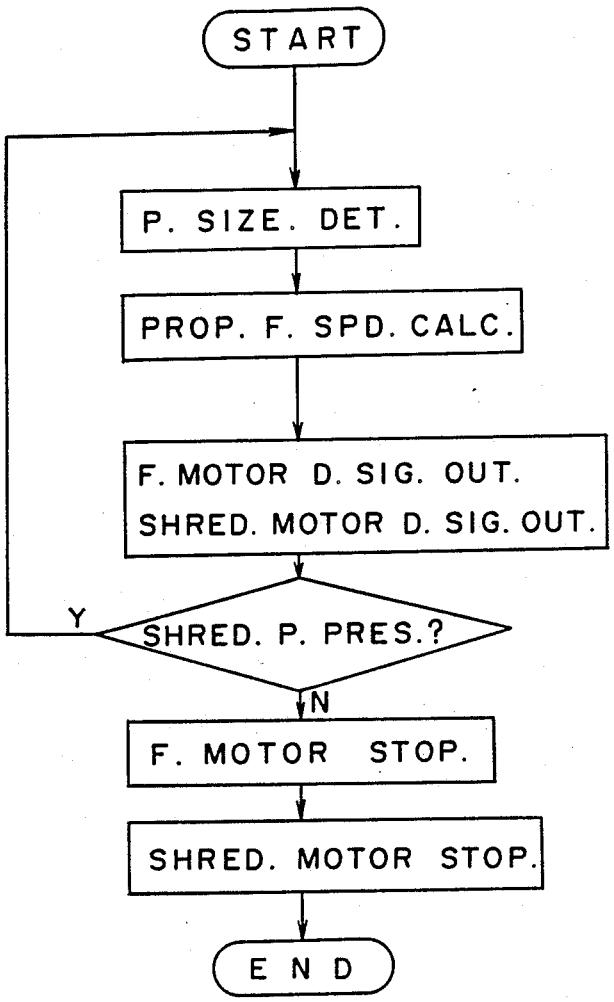
FIG. 4 is a flow-cart for explaining the function of the control circuit.

Subsequently, functioning of the automatic paper feeder as described so far will be explained (FIG. 4).

First, a large number of paper sheets P to be shredded are placed on the paper feeding table 1, whereby the size of the paper sheets P to be shredded is detected by the paper size detecting sensors $S_1$ and $S_2$, and the rotational peripheral speed $V_2$ of the feeding roller 3 necessary for shredding said size of paper sheets in the perfectly two-layered state is calculated. The feeding roller 3, transport roller 7 and shredding blades 2 start to rotate. The state at this time will be explained with reference to the time-chart in FIG. 2, in which the rotational peripheral speed $V_2$ of the feeding roller 3 is set in such a degree as to be slightly smaller than two times the rotational peripheral speed $V_1$, of the shredding blades 2. The feeding roller 3 is positioned at the preliminarily overlapping distance k from the leading edge of the paper sheet P, while a distance D from the feeding roller 3 to the shredding blades 2 is slightly shorter than a length 1 of the paper sheet P to be shredded.

The preceding paper sheet $P_1$ on the uppermost stage as fed by the rotational peripheral speed $V_2$ at the starting time 0t of the feeding roller 3, reaches the shredding blades 2 in its leading edge at a time point 4t. At a time point 5t, the preceding paper sheet $P_1$ is slightly curved, since the rotational peripheral speed $V_2$ of the feeding roller 3 is larger than the rotational peripheral speed $V_1$ of the shredding blades 2, but owing to the fact that the trailing edge of said paper sheet reaches the position of the feeding roller 3, the leading edge of the succeeding paper sheet $P_2$ at the second stage is fed by the feeding roller 3 in the next moment so as to be transported as it is overlapped with the under surface of the preceding paper $P_1$ at a time point 6t.

Thus, at a time point 9t, the first half portion of the succeeding paper sheet $P_2$ overlaps the latter half portion of the preceding paper sheet $P_1$ in two layers, and the preceding paper sheet $P_1$ and the succeeding paper sheet $P_2$ in such two-layered state are shredded or cut into small strips by the shredding blades 2. Subsequently, at a time point 10t, the trailing edge of the succeeding paper sheet $P_2$ reaches the position of the feeding roller 3, and at a next moment, the paper sheet $P_3$ at a third stage is fed so as to be overlapped, at its first half portion, with the latter half portion of the succeeding paper sheet $P_2$ at a time point 14t. Thereafter, the paper sheets are shredded in such perfectly two-layered state by the shredding blades 2.

Upon completion of the shredding of the paper sheets P through repetition of the above processing, the motors $M_1$ and $M_2$ for the feeding roller 3 and the shredding blades 2 are stopped by the paper presence/absence detecting sensors.

As is seen from the foregoing description, at the shredding position of the shredding blades 2, since the preceding paper sheet $P_1$ and the succeeding paper sheets $P_2$ and $P_3$ are shredded in the perfectly two-layered state, with approximately half portions thereof being overlapped with each other (i.e. the state at the time point 14t), the shredding processing time is remarkably reduced as compared with that in the conventional shredding in two-layers at the forward end portions.

It is to be noted here that the present invention is not limited in its application to the foregoing embodiment alone, but may be modified in various ways within the scope.

For example, by altering the calculating equation referred to earlier as $$V_2=3V_1\cdot(L-k)/L$$

the proper feeding speed calculating means 12 can realize a perfectly three-layered shredding in which the forward $\frac{2}{3}$ portion of the succeeding paper sheet is overlapped with the latter $\frac{2}{3}$ portion of the proceeding paper sheet. Meanwhile, the automatic paper feeder in the foregoing embodiment may be so modified that by eliminating the size detecting sensors $S_1$ and $S_2$ for detectinfg the sizes of the large paper sheets and small paper sheets placed on the paper feeding table 1, and also, the control circuit 10 for outputting the rotational speed changing signal for the feeding roller 3 according to the paper size signals of the sensors $S_1$ and $S_2$, the rotational speed of the feeding roller 3 is fixed to correspond to the paper size for the largest consumption.

As is clear from the foregoing description, according to the present invention, since the rotational peripheral speed of the feeding roller is set to be larger than the rotational peripheral speed of the shredding blades and such rotational peripheral speeds of the shredding blades and feeding roller are so related that the paper sheets are shredded by the shredding blades in the layered state in which the forward portion of the successive paper sheet is overlapped, by a large length, with the rear portion of the preceding paper sheet there is achieved a superior effect by which the shredding time for the paper sheets may be markedly reduced.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. An automatic paper feeder and document shredder, comprising:

a paper feeding table for placing thereon, a stack of paper sheets to be shredded;

a feeding roller for feeding the paper sheets to be shredded on the paper feeding table, to a set of shredding blades which rotate at a rotational peripheral speed;

a driving device for driving said feeding roller for rotation at a rotational peripheral speed, said rotational speed of said feeding roller being faster than the rotational speed of said shredding blades;

size detecting sensors for detecting sizes of large paper sheets and small paper sheets placed on the paper feeding table; and a control circuit which outputs a rotational speed changing signal for the feeding roller, to the driving device according to paper size signals of said sensors, said control circuit comprises paper size judging means for judging large sized paper sheets and small sized paper sheets by the outputs from the paper size detecting sensors, proper feeding speed calculating means for calculating a proper rotational peripheral speed $V_2$ of the feeding roller by the output signal of the judging means, feeding motor driving signal output means for driving a motor for the feeding roller by the output signal of the calculating means, shredding motor driving signal output means for driving a motor for the shredding blades and paper presence/absence judging means for judging whether the paper sheet is present or absent by the output of paper presence/absence detecting sensors coupled therewith.

2. An automatic paper feeder as claimed in claim 1, wherein said proper feeding speed calculating means calculates the proper rotational peripheral speed $V_2$ of the feeding roller based on an equation $$V_2=2V_1\cdot(L-k)/L$$

where $V_1$: Shredding blades rotational peripheral speed, $V_2$: Feeding roller rotational peripheral speed, L: Paper sheet length in shredding direction, k: Preliminarily overlapping length of paper sheets to be shredded.

3. The automatic paper feeder as claimed in claim 1, wherein said proper feeding speed calculating means calculates the proper rotational peripheral speed $V_2$ of the feeding roller based on an equation $$V_2=3V_1\cdot(L-k)/L$$

where $V_1$: Shredding blades rotational peripheral speed, $V_2$: Feeding roller rotational peripheral speed, L: Paper sheet length in shredding direction, k: Preliminarily overlapping length of paper sheets to be shredded.

* * * * *